US008484039B2

(12) United States Patent
Aoyagi et al.

(10) Patent No.: US 8,484,039 B2
(45) Date of Patent: Jul. 9, 2013

(54) APPARATUS FOR EFFICIENTLY MIXING NARROWBAND AND WIDEBAND VOICE DATA AND A METHOD THEREFOR

(75) Inventors: Hiromi Aoyagi, Kanagawa (JP); Shinji Usuba, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 524 days.

(21) Appl. No.: 12/656,556

(22) Filed: Feb. 3, 2010

(65) Prior Publication Data

US 2010/0241435 A1 Sep. 23, 2010

(30) Foreign Application Priority Data

Mar. 23, 2009 (JP) ..... 2009-070810

(51) Int. Cl.
*G10L 19/00* (2006.01)

(52) U.S. Cl.
USPC ..... 704/501

(58) Field of Classification Search
USPC ..... 704/500–504
See application file for complete search history.

(56) References Cited

U.S. PATENT DOCUMENTS 6,680,972 B1 * 1/2004 Liljeryd et al. ..... 375/240
2002/0007280 A1 * 1/2002 McCree ..... 704/500
2002/0052738 A1 * 5/2002 Paksoy et al. ..... 704/219
2004/0125878 A1 * 7/2004 Liljeryd et al. ..... 375/242
2004/0131203 A1 * 7/2004 Liljeryd et al. ..... 381/98
2012/0002818 A1 * 1/2012 Heiko et al. ..... 381/22

FOREIGN PATENT DOCUMENTS

JP 6-078062 A 3/1994
JP 2005-229259 A 8/2005

OTHER PUBLICATIONS

Shigeaki Sasaki, et al., "Global Standard for Wideband Voice Coding, ITU-T G.711.1 (G.711 Wideband extension)", NTT Technical Journal May 2008.

* cited by examiner

*Primary Examiner* — Michael N Opsasnick
(74) *Attorney, Agent, or Firm* — Rabin & Berdo, P.C.

(57) ABSTRACT

A voice mixing apparatus decodes input encoded narrowband voice data and encoded voice data for narrowband region of input encoded wideband voice data, and detects a speaker in accordance with the decoded voice signals of the entire narrowband. When encoded voice data from a speaker is included in the narrowband, a signal in a region outside the narrowband of the expanded data is encoded. When the data is included in the wideband, encoded voice data of the region outside the narrowband is extracted for output. When the destination terminal is compatible with the encoded narrowband voice data, the narrowband voice signal mixed is encoded and output. When the destination terminal is compatible with wideband, the narrowband voice signal mixed is encoded for the narrowband region, and the voice data of the speaker is used as the encoded voice data for the region outside the narrowband.

12 Claims, 4 Drawing Sheets

FROM 101-1
FROM 101-N
FROM 102-1
FROM 102-M
201-1
TELEPHONE BAND DECODER 1
201-N
TELEPHONE BAND DECODER N
202-1
WIDEBAND DECODER 1
202-M
WIDEBAND DECODER M
SPEAKER DETECTER
207
BAND EXPANDER 1
203-1
BAND EXPANDER N
203-N
WIDEBAND REGION ENCODER
208
WIDEBAND REGION SELECTOR
209
204-1
MIXER 1
204-N
MIXER N
204-(N+1)
MIXER N+1
MIXER N+M
204-(N+M)
205-1
TELEPHONE BAND ENCODER 1
205-N
TELEPHONE BAND ENCODER N
206-1
WIDEBAND ENCODER 1
206-M
WIDEBAND ENCODER M
TO 101-1
TO 101-N
TO 102-1
TO 102-M

APPARATUS FOR EFFICIENTLY MIXING NARROWBAND AND WIDEBAND VOICE DATA AND A METHOD THEREFOR

BACKGROUND OF THE INVENTION

1. Field of the Invention

The present invention relates to a voice mixing apparatus and a method therefor, and more particularly to a voice conference system advantageously applicable to voice mixing for use in, for example, a voice conference system including both a client terminal compatible with wideband transmission and a client terminal incompatible with wideband transmission.

2. Description of the Background Art

In recent years, VoIP (Voice over Internet Protocol) telecommunications networks have been widely proliferating. The VoIP is not subjected to restriction on its voice bandwidth unlike the landline telephone network, which has its transmission band restricted to the frequency band from 300 Hz to 3.4 kHz, and therefore enables communications with more natural sound quality, or wideband sound quality. In order to transmit the wideband voice, wideband voice coding schemes are employed. Among these is one having its architecture scalable so as to be higher in compatibility to existing voice coding systems, as taught by Shigeaki Sasaki, et al., "Global Standard for Wideband Voice Coding, ITU-T G.711.1 (G.711 Wideband extension)", NTT Technical Journal, May 2008.

The scalable voice coding system employs as its core coding the conventional voice data coding, e.g. voice data coding in the telephone frequency band per G.711, to add encoded data of a frequency band exceeding the telephone band to data encoded in the core to thereby produce encoded wideband voice data. Such a frequency band above the telephone band may sometimes be referred to as a wideband or higher-band region. One of the advantages of this scheme is the simplicity in voice mixer processing.

Voice mixing for multi-point communications such as a voice conference system requires to decode and re-encode voice data sent from a plurality of locations. The required decoding and re-encoding of voice data are carried out only on the legacy voice codec section that requires a relatively less amount of computation, while the wideband region is dealt with by simply duplicating encoded information from the speaker toward respective points. This scheme achieves wideband voice mixing with less amount of computation.

In a multi-point communications system that involves a client terminal based on the conventional voice coding in the telephone band and a client terminal that is compatible to the wideband voice coding, however, voice signals coming from such a terminal based on the conventional voice coding are transmitted and mixed only into the telephone band, thus failing to fully enjoy the benefit of the wideband coding. Moreover, a telecommunications system including both a client terminal compatible with the telephone band and a client terminal compatible with the wideband inherently involves a fundamental problem that a voice signal sent from the telephone band terminal is delivered in the form of voice signal in the telephone band even to the wideband terminal.

SUMMARY OF THE INVENTION

It is an object of the present invention to provide a voice mixing apparatus and a method therefor capable of overcoming the problems described above.

It is a more specific object of the present invention to provide a voice mixing apparatus and a method therefor that enable effective mixing in terms of sound quality and computational load even in a multi-point communications system conveying telephone band and wideband voice signals.

In accordance with the present invention, a voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, comprises: a narrowband decoder that decodes the input encoded narrowband voice data to thereby produce N narrowband voice signals; a wideband decoder that splits the input encoded wideband voice data into the first encoded voice data and the second encoded voice data, and decodes the first encoded voice data to thereby produce M narrowband voice signals; a maximum narrowband voice signal detector that detects a first signal highest in level among N+M narrowband voice signals including the N narrowband voice signals and the M narrowband voice signals; a selector that expands, when the first signal is detected among the N narrowband voice signals, the first signal into a wideband voice signal and then encodes a signal of a region outside the narrowband of the expanded wideband voice signal to output the encoded signal, and outputs, when the first signal is detected among the M narrowband voice signals, the first encoded voice data and the second encoded voice data; a mixer that mixes the narrowband voice signal obtained through decoding by the narrowband decoder with the narrowband voice signal obtained through decoding by the wideband decoder to thereby produce a second signal; a narrowband encoder that encodes the second signal when a destination terminal is compatible with the encoded narrowband voice data; and a wideband encoder that encodes, when the destination terminal is compatible with the encoded wideband voice data, the narrowband region of the second signal to thereby produce first encoded voice data, and combining the first encoded voice data produced with the second encoded voice data output from the selector to thereby form the encoded wideband voice data of layered structure.

Also in accordance with the present invention, a voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, comprises: a narrowband decoder that decodes the input encoded narrowband voice data to thereby produce N narrowband voice signals; a wideband decoder that decodes the input encoded wideband voice data; a band expander that expands the N narrowband voice signals into a wideband voice signal; a mixer that mixes the wideband voice signal obtained through decoding by the wideband decoder with the wideband voice signal obtained by the band expander to thereby produce a first signal; a band limiter that converts, when a destination terminal is compatible with the encoded narrowband voice data, the first signal into a narrowband voice signal; a narrowband encoder that encodes the narrowband voice signal output from the band limiter; and a wideband encoder that encodes, when the destination terminal is compatible with the encoded wideband voice data, the first signal to thereby produce the encoded wideband voice data of layered structure.

Further in accordance with the present invention, a voice mixing method of carrying out mixing on encoded narrowband voice data sent from N narrowband terminals, where N is a natural number, and encoded wideband voice data of layered structure that are sent from M wideband terminals, where M is a natural number, the encoded wideband voice data including first encoded voice data for a narrowband region and second encoded voice data for a region outside a narrowband, comprises the steps of: decoding by a narrowband decoder the input encoded narrowband voice data to thereby produce N narrowband voice signals; splitting by a wideband decoder the input encoded wideband voice data into the first encoded voice data and the second encoded voice data, and decoding the first encoded voice data to thereby produce M narrowband voice signals; detecting by a maximum narrowband voice signal detector a first signal highest in level among N+M narrowband voice signals including the N narrowband voice signals and the M narrowband voice signals obtained; expanding by a selector the first signal into a wideband voice signal and then encoding a signal of a region outside the narrowband of the expanded wideband voice signal to output the encoded signal when the first signal is detected among the N narrowband voice signals, or outputting the first encoded voice data and the second encoded voice data when the first signal is detected among the M narrowband voice signals; mixing by a mixer the narrowband voice signal obtained through decoding by the narrowband decoder with the narrowband voice signal obtained through decoding by the wideband decoder to thereby produce a second signal; encoding by a narrowband encoder the second signal when a destination terminal is compatible with the encoded narrowband voice data; and encoding by a wideband encoder the narrowband region of the second to thereby produce first encoded voice data when the destination terminal is compatible with the encoded wideband voice data, and combining the first encoded voice data with the second encoded voice data output from the selector to thereby form the encoded wideband voice data of layered structure.

Still further in accordance with the present invention, a voice mixing method of carrying out mixing on encoded narrowband voice data sent from N narrowband terminals, where N is a natural number, and encoded wideband voice data of layered structure that are sent from M wideband terminals, where M is a natural number, the encoded wideband voice data including first encoded voice data for a narrowband region and second encoded voice data for a region outside a narrowband, comprises the steps of: decoding by a narrowband decoder the input encoded narrowband voice data to thereby produce N narrowband voice signals; decoding by a wideband decoder the input encoded wideband voice data; expanding by a band expander the N narrowband voice signals into a wideband voice signal; mixing by a mixer the wideband voice signal obtained through decoding by the wideband decoder with the wideband voice signal obtained by the band expander to thereby produce a first signal; converting by a band limiter the first signal into a narrowband voice signal when a destination terminal is compatible with the encoded narrowband voice data; encoding by a narrowband encoder the narrowband voice signal output from the band limiter; and encoding by a wideband encoder the first signal to thereby produce the encoded wideband voice data of layered structure when the destination terminal is compatible with the encoded wideband voice data.

In an aspect of the invention, provided is a voice mixing program which controls, when installed and executed on a computer, the computer to function as the voice mixing apparatus as described above.

In another aspect of the invention, a voice conference system is provided which comprises the voice mixing apparatus as described above.

Thus, the present invention makes it possible to achieve mixing operation that is efficient in terms of both sound quality and processing capacity during multi-point communications, even in such a situation as narrowband and wideband voice signals coexist.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 2:
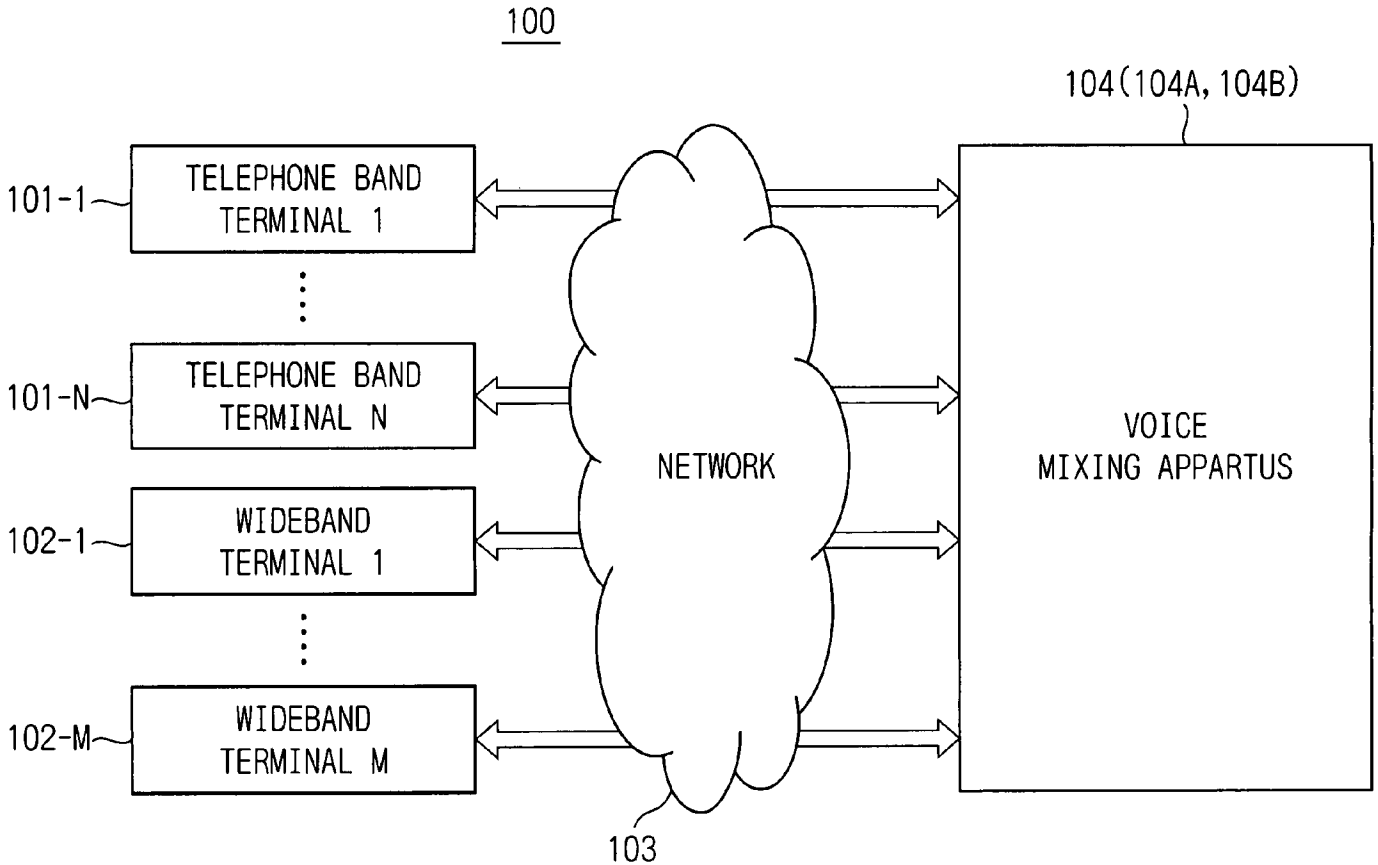
FIG. 2 is a schematic block diagram showing the network constitution of a voice conference system in accordance with the illustrative embodiment.

An illustrative embodiment of the voice mixing apparatus applied to a voice conference system according to the present invention will be described in detail with reference to the accompanying drawings. With reference to FIG. 2 first, which is a schematic block diagram showing the constitution of a voice conference system 100 of the illustrative embodiment, the voice conference system 100 comprises a plurality (N) of telephone band terminals 101-1 to 101-N, where N is a natural number, a plurality (M) of wideband terminals 102-1 to 102-M, where M is a natural number, and a voice mixing apparatus 104, where these components are connectable to each other over a telecommunications network 103.

Any of the telephone band terminal 101-1 to 101-N may be represented with a reference numeral 101-*n*, where n is an integer from 1 to N, inclusive. The terminal 101-*n* is a client terminal of the voice conference system 100, and is adapted to encode and decode voice signals in the telephone band having its frequency range from 300 Hz to 3.4 kHz, for example.

Similarly, any of the wideband terminal 102-1 to 101-M may be represented with a reference numeral 102-*m*, where m is an integer from 1 to M, inclusive. The wideband terminal 102-*m* is also a client terminal that is adapted to encode and decode voice signals in the wideband or broadband ranging from 300 Hz to 7 kHz, for example. The wideband terminal 102-*m* may have its wideband coding system in accordance with the scalable structure as disclosed by Shigeaki Sasaki, et al., pp. 34-37 described in the introductory part of the specification. According to this system, encoded data in the telephone band, for example, from 300 Hz to 3.4 kHz, are combined with encoded data in the higher-band region, for example, from 3.4 kHz to 7 kHz, exceeding the telephone band to thereby form encoded voice data in the layered structure.

The voice mixing apparatus 104 is connected to the network 103 to receive encoded voice data from the N telephone band terminals 101-1 to 101-N and encoded voice data from the M wideband terminals 102-1 to 102-M over the network 103. The voice mixing apparatus 104 serves as decoding the encoded data from those terminals, mixes the resultant voice signals, and encodes the mixed voice signal to send the resultant signal over the network 103 to the telephone band terminals 101-1 to 101-N and the wideband terminals 102-1 to 102-M.

There is no restriction on the type of network 103 as long as it is capable of transmitting the encoded voice data. For example, a closed network such as an intranet of a corporation may be used.

Figure 1:
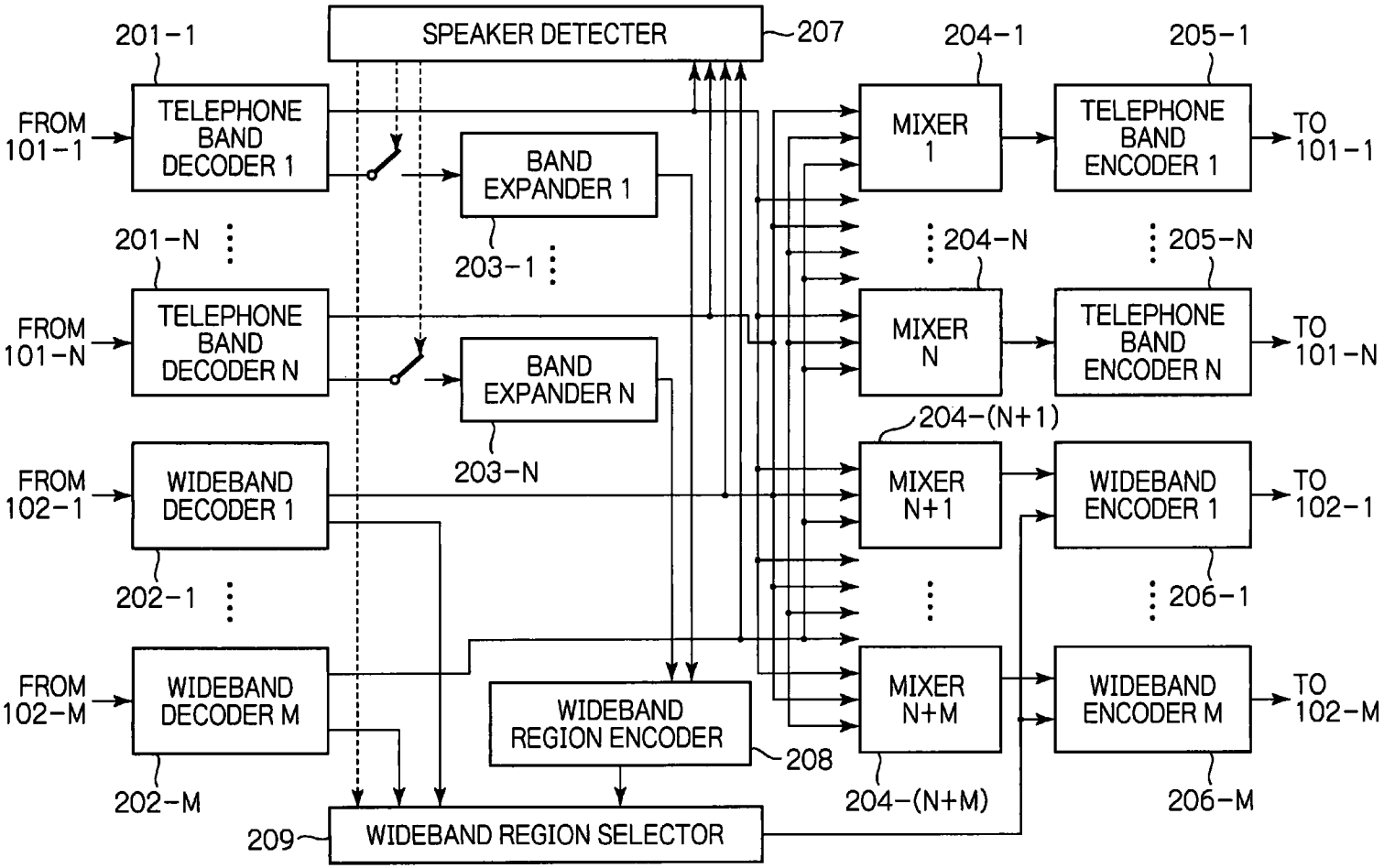
FIG. 1 is a schematic block diagram showing the functional constitution of a voice mixing apparatus in accordance with an illustrative embodiment of the present invention.

FIG. 1 is a schematic block diagram showing the functional constitution of the voice mixing apparatus 104 of the illustrative embodiment. The voice mixing apparatus 104 may be constituted in practice by installing and executing program sequences for mixing voice data on a computer functionable as a server. In FIG. 1, however, the functional features of the apparatus 104 are depicted in the form of blocks. In this connection, the word "circuit" may be understood not only as hardware, such as an electronics circuit, but also as a function that may be implemented by software installed and executed on a computer.

With reference now to FIG. 1, the voice mixing apparatus 104 comprises a corresponding plurality (N) of telephone band decoders 201-1 to 201-N, a corresponding plurality (M) of wideband decoders 202-1 to 202-M, a corresponding plurality (N) of band expanders 203-1 to 203-N, a plurality (N+M) of mixers 204-1 to 204-(N+M), a corresponding plurality (N) of telephone band encoders 205-1 to 205-N, a corresponding plurality (M) of wideband encoders 206-1 to 206-M, a speaker detector 207, a wideband region encoder 208 and a wideband-region selector 209, which are interconnected as illustrated.

In the description, a plurality N or M of functional blocks will be described with any one of them representatively designated with a suffix n or m, respectively. For example, the telephone band decoder 201-*n* will representatively be described rather than describing all of the telephone band decoders 201-1 through 201-N. Now, the telephone band decoder is adapted to receive and decode the encoded voice data of the telephone band transmitted from the corresponding telephone band terminal 101-*n*.

The wideband decoder 202-*m* is adapted to decode only the encoded voice data of the telephone band included in the layered encoded voice data transmitted from the corresponding wideband terminal 102-*m* to output resultant encoded data, and pass the encoded voice data of the higher-band region involved in the layered data as it is.

The speaker detector 207 is adapted for detecting one, highest in level, of the voice data of the telephone band that have been decoded by the telephone band decoders 201-1 to 201-N and the wideband decoders 202-1 to 202-M. The speaker detector 207 is also adapted for feeding the wideband region encoder 208 with information on a decoder that has output the voice data of the highest level. The speaker detector 207 is further adapted for controlling, when it determines that one (201-*i*) of the telephone band decoders 201-1 to 201-N has output the voice data of the highest level, the band expander 203-*i* corresponding to that telephone band decoder 201-*i* to execute the band expansion and causes the output thereof to be processed by the wideband region encoder 209. In that case, i is a natural number between 1 and N, inclusive. The speaker detector 207 may be adapted for providing the wideband region encoder 208 with a signal indicative of an input port to be selected, instead of information on a decoder having output the voice data of the highest level.

In the resent patent application, the word "user" is directed to a person who deals with a telephone terminal, such as terminals 101-1 or 102-M. Such a user may sometimes be referred to as a "talker" when talking on the phone and also to a "listener" when listening to the other user.

The band expander 203-*n* is responsive to an instruction from the speaker detector 207 to expand the telephone band of voice data that has been output from the corresponding telephone band decoder 201-*n* into the wideband of voice data. The band expanders 203-1 to 203-N are thus rendered alternatively or selectively operative, and not all of the expanders may be rendered operative. Alternatively, all of the band expanders 203-1 to 203-N may be adapted to execute the expansion, and the speaker detector 207 controls the band expanders to selectively develop one of the N pieces of wideband voice data that have been expanded. Further alternatively, for example, the mixing apparatus 104 may be designed so as to include only one band expander, which may be informed by the speaker detector 207 of one (201-*i*) of the telephone band decoders 201-1 to 201-N which is to be fed with the telephone band voice data.

The wideband region encoder 208 functions as encoding data of higher-band region above the telephone band in the band-expanded voice data that has been input. The wideband region encoder 208 encodes data by scalable encoding to output the encoded voice data of the higher-band region. In case band-expanded voice data is not output from any of the band expanders 203-1 to 203-N, the wideband region encoder 208 does not proceed to encoding, as a matter of course.

The wideband region selector 209 is connected to receive encoded voice data of wider-band region that is output from the wideband decoders 202-1 to 202-M and encoded voice data of wider-band region that is produced by the wideband region encoder 208. The wideband region selector 209 functions as selecting encoded voice data of wider-band region of a speaker having the highest level under the control of the speaker detector 207 to output the selected data. The encoded voice data of wider-band region of the speaker having the highest level thus output is fed to all of the wideband encoders 206-1 to 206-M.

Each of the mixers 204-1 to 204-(N+M) is interconnected, as shown in FIG. 1, so as to receive the telephone band voice data output from a number (N+M−1) of decoders except a decoder that corresponds in number thereto. For example, the mixer 204-1 receives the telephone band voice data that is output from the decoders 201-2 to 201-N and 202-1 to 202-M. The mixer 204-(N+1) receives the telephone band voice data that is output from the decoders 201-1 to 201-N and decoders 202-2 to 202-M. Each of the mixers 204-1 to 204-(N+M) mixes (N+M−1) pieces of telephone band voice data that have been input. Alternatively, each of the mixers 204-1 to 204-(N+M) may be connected to receive and mix all of the (N+M) pieces of telephone band voice data.

The telephone band encoder 205-*n* functions as encoding the mixed voice data of the telephone band fed by the corresponding mixer 204-*n*, and sending the encoded data to the corresponding telephone band terminal 101-*n* over the network 103.

The wideband encoder 206-*m* functions as encoding the mixed voice data of the telephone band fed by the corresponding mixer 204-(N+m), and combining the encoded voice data of the telephone band with the encoded voice data of wider-band region of the speaker having the highest level that is fed by the wideband region selector 209 to thereby form the encoded voice data of layered structure to transmit the resultant data to the corresponding wideband terminal 102-*m* over the network 103.

In operation, the encoded voice data of the telephone band that is output from the telephone band terminal 101-*n* is fed to the corresponding telephone band decoder 201-*n* and is decoded thereby.

On the other hand, the encoded voice data of layered structure that is output from the wideband terminal 102-*m* is fed to the corresponding wideband decoder 202-*m*, so that only the encoded voice data of the telephone band among the layered encoded voice data is decoded and output, while the encoded voice data of higher-band region is output as it is without being decoded.

The speaker detector 207 is fed with telephone band voice data that are decoded by the telephone band decoders 201-1 to 201-N and the wideband decoders 202-1 to 202-M to detect the voice data of the highest level.

When the wideband decoder 202-*m* has output the voice data of the highest level, for example, the encoded voice data of the higher-band region that is output by the wideband decoder 202-*m* is selected by the wideband region selector 209 and is sent to all wideband encoders 206-1 to 206-M.

Differently, for example, when the telephone band decoder 201-*n* has output the voice data of the highest level, the telephone band voice data that is output by the telephone band decoder 201-*n* is expanded into wideband voice data by the band expander 203-*n*. Then, the higher-band region of the band-expanded voice data that is outside the telephone band is encoded by the wideband region encoder 208, and the encoded voice data of the higher-band region thus obtained is selected by the wideband region selector 209 to be sent to all wideband encoders 206-1 to 206-M.

Each of the mixers 204-1 to 204-(N+M) mixes (N+M−1) pieces of telephone band voice data that have been input, and transfers the mixed data to the corresponding telephone band encoders 205-1 to 205-N and wideband encoders 206-1 to 206-M.

The telephone band encoder 205-*n* encodes the mixed voice data of the telephone band fed by the corresponding mixer 204-*n* and sends the encoded voice data of the telephone band to the corresponding telephone band terminal 101-*n* over the network 103.

In contrast, the wideband encoder 206-*m*, in the meantime, encodes the mixed voice data of the telephone band fed by the corresponding mixer 204-(N+m), and combines the encoded voice data of telephone band with the encoded voice data of wider-band region of the speaker having the highest level fed by the wideband region selector 209 to thereby form the encoded voice data of layered structure, which will in turn be transmitted to the corresponding wideband terminal 102-*m* over the network 103.

In summary, according to the illustrative embodiment, in a teleconferencing system in which telephone band and wideband terminals coexist, even the voice signal of a speaker who uses a telephone band terminal is expanded over a wideband so as to obtain encoded data of higher-band region, which will be included in wideband voice data that is layered in structure and destined to wideband terminals. Thus, a less amount of processing allows the user of a wideband terminal to listen to wideband voice with, regardless of the type of a speaker's terminal.

An alternative embodiment of the voice mixing apparatus according to the present invention will be described with reference to FIG. 3. The alternative embodiment may also be applied to the voice conference system 100 shown in and described with reference to FIG. 2 in place of the voice mixing apparatus 104. In the application, like components are designated with the same reference numerals.

Figure 3:
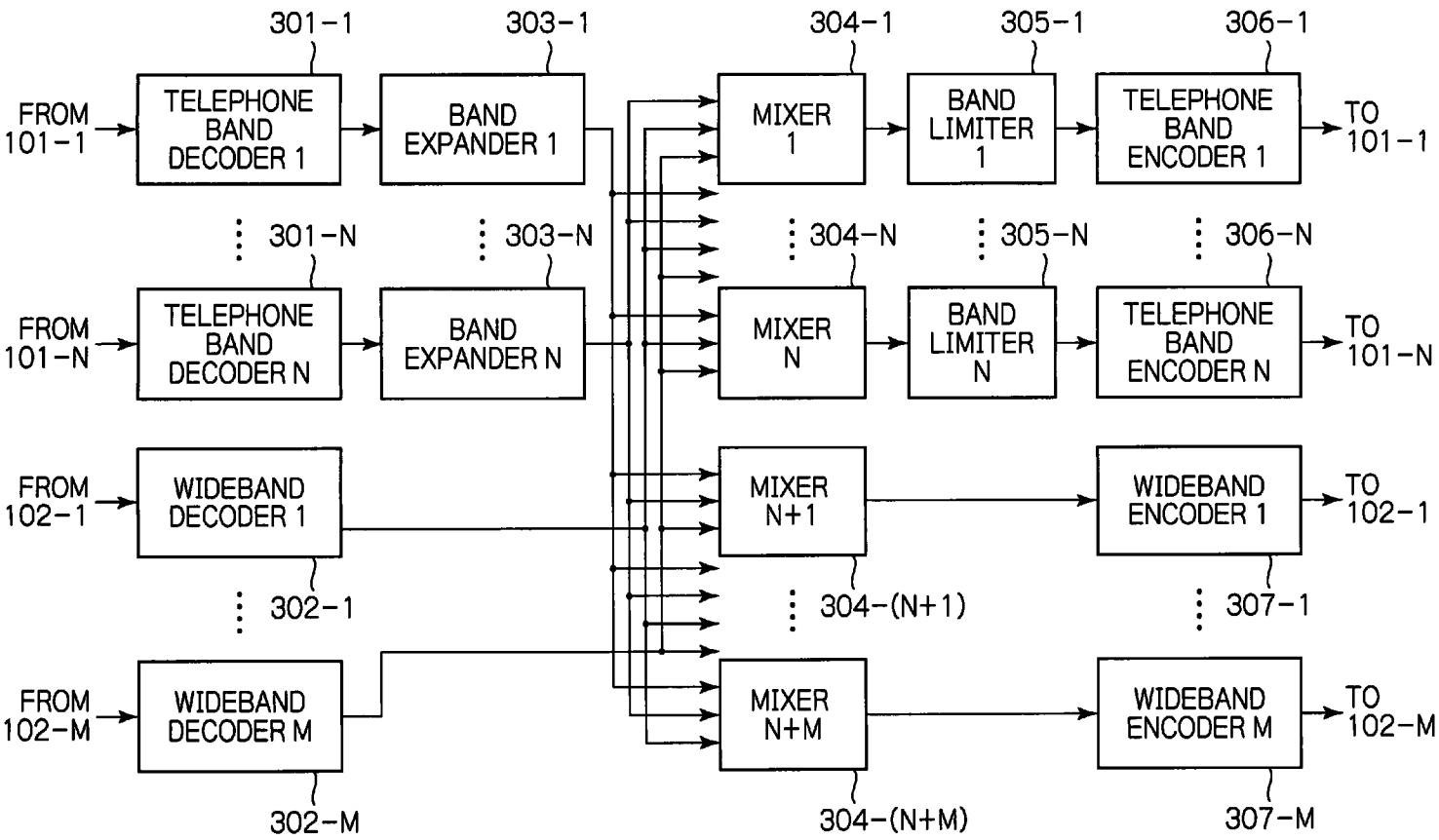
FIG. 3 is a schematic block diagram, like FIG. 1, showing the functional constitution of a voice mixing apparatus in accordance with an alternative embodiment of the present invention.

FIG. 3 is a schematic block diagram showing the functional constitution of the voice mixing apparatus 104A of the alternative embodiment. The voice mixing apparatus 104A comprises N telephone band decoders 301-1 to 301-N, M wideband decoders 302-1 to 302-M, N band expanders 303-1 to 303-N, N+M mixers 304-1 to 304-(N+M), N band limiters 305-1 to 305-N, N telephone band encoders 306-1 to 306-N and M wideband encoders 307-1 to 307-M, which are interconnected as shown.

The telephone band decoder 301-*n* is adapted to decode the encoded voice data of telephone band sent from the corresponding telephone band terminal 101-*n*.

The wideband decoder 302-*m* is adapted to decode the layered encoded voice data sent from the corresponding wideband terminal 102-*m*. That is, the wideband decoder 302-*m* of the alternative embodiment decodes the encoded voice data of telephone band and decodes the encoded voice data of the higher-band region to thereby obtain wideband voice data.

The band expander 303-*n* is adapted to expand the telephone band of voice data that has been output from the corresponding telephone band decoder 301-*n* into the wideband of voice data.

Each of the mixers 304-1 to 304-(N+M) is interconnected, as shown in the figure, so as to be fed with wideband voice data that is output from a' number (N+M−1) of expanders and decoders except a band expander or a wideband decoder corresponding in number thereto. For example, the mixer 304-1 receives the wideband voice data that is output from the band expanders 303-2 to 303-N and the wideband decoders 302-1 to 302-M. The mixer 304-(N+1) receives the wideband voice data that is output from the band expanders 303-1 to 303-N and the wideband decoders 302-2 to 302-M. Each of the mixers 304-1 to 304-(N+M) mixes N+M−1 pieces of input wideband voice data. Alternatively, each of the mixers 304-1 to 304-(N+M) may be connected to receive and mix (N+M) pieces of wideband voice data.

The band limiter 305-*n* is adapted for limiting the frequency band of the mixed voice data of wideband that is fed by the corresponding mixer 304-*n* to the telephone band of voice data.

The telephone band encoder 306-*n* is adapted to encode the voice data of telephone band fed by the corresponding band limiter 305-*n* to transmit the resultant data to the corresponding telephone band terminal 101-*n* over the network 103.

The wideband encoder 307-*m* is adapted to encode the mixed voice data of wide band fed by the corresponding mixer 304-(N+m) and forms the encoded voice data of layered structure to transmit the resultant data to the corresponding wideband terminal 102-*m* over the network 103.

In operation, the encoded voice data of the telephone band that is output from the telephone band terminal 101-*n* is fed to the corresponding telephone band decoder 301-*n* and is decoded thereby. The data is then expanded into wideband voice data by the band expander 303-*n*.

The encoded voice data of layered structure that is output from the wideband terminal 102-*m* is fed to the corresponding wideband decoder 302-*m* and is decoded thereby. The wideband decoder 302-*m* of the instant alternative embodiment thus decodes both encoded voice data of the telephone band and the higher-band region.

Each of the mixers 304-1 to 304-(N+M) mixes N+M−1 pieces of wideband voice data that have been input from the predetermined band expanders and the wideband decoders, and forwards the mixed data to the corresponding telephone band limiters 305-1 to 305-N and wideband encoders 307-1 to 307-M.

The telephone band limiter 305-*n* then limits the frequency band of the mixed voice data of wideband fed by the corresponding mixer 304-*n* to the telephone band of voice data. The data is then encoded by the telephone band encoder 306-*n* and is transmitted toward the corresponding telephone band terminal 101-*n* over the network 103.

The wideband encoder 307-*m* encodes the mixed voice data of wideband that is fed from the corresponding mixer 304-(N+m) to thereby form the encoded voice data of layered structure, and transmits the resultant data to the corresponding wideband terminal 102-*m* over the network 103.

In short, according to the alternative embodiment, in a teleconferencing system in which telephone band and wideband terminals coexist, the decoded telephone band voice data are expanded in its entirety into wideband voice data, which are then mixed, re-encoded and delivered to the users of wideband terminals. The users can therefore listen to the voices in wideband.

Figure 4:
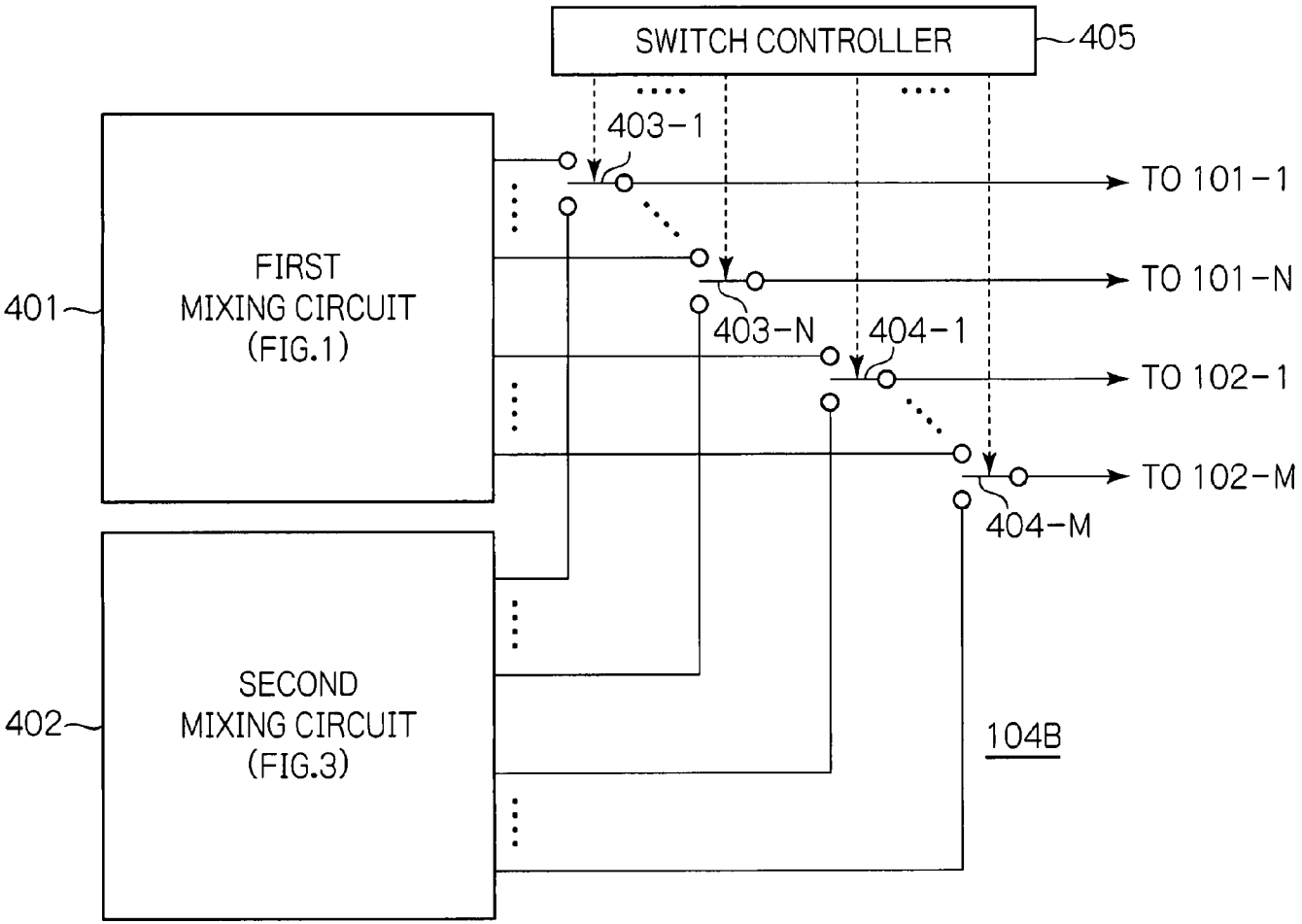
FIG. 4 is a schematic block diagram showing the functional constitution of a voice mixing apparatus in accordance with another alternative embodiment of the present invention.

Another alternative embodiment of the voice mixing apparatus also applicable to a voice conference system according to the present invention will be described with reference to FIG. 4. FIG. 4 is a schematic block diagram showing the functional constitution of the voice mixing apparatus 104B of the other alternative embodiment.

The voice mixing apparatus 104B comprises a first mixing circuit 401 having its constitution similar to that of the voice mixing apparatus 104, FIG. 1, a second mixing circuit 402 having its constitution similar to that of the voice mixing apparatus 104A, FIG. 3, N telephone band switches 403-1 to 403-N, M wideband switches 404-1 to 404-M and a switch controller 405, which are interconnected as depicted.

The first and second mixing circuits 401 and 402 may be designed so that the telephone band decoders 201-1 to 201-N, the band expander 203-1 to 203-N and the telephone band encoders 205-1 to 205-N, FIG. 1, of the first mixing circuit 401 are respectively shared with the telephone band decoders 301-1 to 301-N, the band expanders 303-1 to 303-N and the telephone band encoders 306-1 to 306-N, FIG. 3, of the second mixing circuit 402, in other words, a single set of those circuits may be arranged.

The telephone band switch 403-*n* functions, under the control of the switch controller 405, to select either the encoded voice data of telephone band transferred from the telephone band encoder 205-*n*, FIG. 1, of the first mixing circuit 401 or the encoded voice data of telephone band transferred from the telephone band encoder 306-*n*, FIG. 3, of the second mixing circuit 402.

The wideband switch 404-*m* functions, under the control of the switch controller 405, to select either the encoded voice data of wideband sent from the wideband encoder 206-*m*, FIG. 1, of the first mixing circuit 401, or the encoded voice data of wideband sent from the wideband encoder 307-*n*, FIG. 3, of the second mixing circuit 402.

The switch controller 405 is arranged such as to obtain, when setting up or initializing the teleconferencing system 104B, from all of the terminals 101-1 to 101-N and 102-1 to 102-M information on which of the first mixing circuit 401 or the second mixing circuit 402 a mixed output is to be selected from, and to control, in accordance with this information, the telephone band switches 403-1 to 403-N and the wideband switches 404-1 to 404-M. The installer or user of the voice mixing apparatus 104B may determine and set in advance which mixing output is employed for the terminals 101-1 to 101-N and 102-1 to 102-M.

The instant alternative embodiment makes it possible to select whether the sound of higher-band region heard by the users of the wideband terminals is to include the voice of one speaker only or the voices of all participants of the conference.

The illustrative embodiments described above are applied to a teleconferencing system. However, the voice mixing apparatus of the invention is not limited to such a specific application. For example, a source terminal transmitting encoded voice data to be mixed may be different from a destination terminal to which the mixed encoded voice data is delivered.

In the illustrative embodiments described above, the wideband voice is constituted by adding the higher-band region to the voice of telephone band, i.e. narrowband. The voice mixing apparatus of the invention may also be applied to wideband or broadband data including, in addition to voice data of the telephone band or narrowband, voice data of higher-band region and/or lower-band region. The present invention can be applied also to such an application case as long as encoded data of a wideband voice signal has layered structure.

The embodiments described above are directed to mixing voice signals. The present invention can, however, be applied also to mixing any types of sound or audio signals, such as music signals. The term "voice signal" in the context should broadly be understood to include any audio or acoustic signals.

The entire disclosure of Japanese patent application No. 2009-070810 filed on Mar. 23, 2009, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, said apparatus comprising:

a first narrowband decoder that decodes the input encoded narrowband voice data to thereby produce N narrowband voice signals;

a first wideband decoder that splits the input encoded wideband voice data into the first encoded voice data and the second encoded voice data, and decodes the first encoded voice data to thereby produce M narrowband voice signals;

a maximum narrowband voice signal detector that detects a first signal highest in level among N+M narrowband voice signals including the N narrowband voice signals and the M narrowband voice signals;

a first selector that expands, when the first signal is detected among the N narrowband voice signals, the first signal into a wideband voice signal and then encodes a signal of a region outside the narrowband of the expanded wideband voice signal to output the encoded signal, and outputs, when the first signal is detected among the M narrowband voice signals, the first encoded voice data and the second encoded voice data;

a first mixer that mixes the narrowband voice signal obtained through decoding by said first narrowband decoder with the narrowband voice signal obtained through decoding by said first wideband decoder to thereby produce a second signal;

a first narrowband encoder that encodes the second signal when a destination terminal is compatible with the encoded narrowband voice data; and a first wideband encoder that encodes, when the destination terminal is compatible with the encoded wideband voice data, the narrowband region of the second signal to thereby produce first encoded voice data, and combining the first encoded voice data produced with the second encoded voice data output from said first selector to thereby form the encoded wideband voice data of layered structure.

2. The apparatus according to claim 1, further comprising:

a second narrowband decoder that decodes the input encoded narrowband voice data to thereby produce N narrowband voice signals;

a second wideband decoder that decodes the input encoded wideband voice data;

a band expander that expands the N narrowband voice signals into a wideband voice signal;

a second mixer that mixes the wideband voice signal obtained through decoding by said second wideband decoder with the wideband voice signal obtained by said band expander to thereby produce a third signal;

a band limiter that converts, when the destination terminal is compatible with the encoded narrowband voice data, the third signal into a narrowband voice signal;

a second narrowband encoder that encodes the narrowband voice signal output from said band limiter;

a second wideband encoder that encodes, when the destination terminal is compatible with the encoded wideband voice data, the third signal to thereby produce the encoded wideband voice data of layered structure; and a second selector that selects either of the encoded wideband voice data output from said first narrowband encoder and the encoded narrowband voice data output from said second wideband encoder, and selects either of the encoded wideband voice data output from said first wideband encoder and the encoded wideband voice data output from said second wideband encoder.

3. A voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, said apparatus comprising:

a narrowband decoder that decodes the input encoded narrowband voice data to thereby produce N narrowband voice signals;

a wideband decoder that decodes the input encoded wideband voice data;

a band expander that expands the N narrowband voice signals into a wideband voice signal;

a mixer that mixes the wideband voice signal obtained through decoding by said wideband decoder with the wideband voice signal obtained by said band expander to thereby produce a first signal;

a band limiter that converts, when a destination terminal is compatible with the encoded narrowband voice data, the first signal into a narrowband voice signal;

a narrowband encoder that encodes the narrowband voice signal output from said band limiter; and a wideband encoder that encodes, when the destination terminal is compatible with the encoded wideband voice data, the first signal to thereby produce the encoded wideband voice data of layered structure.

4. A voice mixing method of carrying out mixing on encoded narrowband voice data sent from N narrowband terminals, where N is a natural number, and encoded wideband voice data of layered structure that are sent from M wideband terminals, where M is a natural number, the encoded wideband voice data including first encoded voice data for a narrowband region and second encoded voice data for a region outside a narrowband, said method comprising the steps of:

decoding by a first narrowband decoder the input encoded narrowband voice data to thereby produce N narrowband voice signals;

splitting by a first wideband decoder the input encoded wideband voice data into the first encoded voice data and the second encoded voice data, and decoding the first encoded voice data to thereby produce M narrowband voice signals;

detecting by a maximum narrowband voice signal detector a first signal highest in level among N+M narrowband voice signals including the N narrowband voice signals and the M narrowband voice signals obtained;

expanding by a first selector the first signal into a wideband voice signal and then encoding a signal of a region outside the narrowband of the expanded wideband voice signal to output the encoded signal when the first signal is detected among the N narrowband voice signals, or outputting the first encoded voice data and the second encoded voice data when the first signal is detected among the M narrowband voice signals;

mixing by a first mixer the narrowband voice signal obtained through decoding by the first narrowband decoder with the narrowband voice signal obtained through decoding by the first wideband decoder to thereby produce a second signal;

encoding by a first narrowband encoder the second signal when a destination terminal is compatible with the encoded narrowband voice data; and encoding by a first wideband encoder the narrowband region of the second to thereby produce first encoded voice data when the destination terminal is compatible with the encoded wideband voice data, and combining the first encoded voice data with the second encoded voice data output from the first selector to thereby form the encoded wideband voice data of layered structure.

5. The method according to claim 4, further comprising the steps of:

decoding by a second narrowband decoder the input encoded narrowband voice data to thereby produce N narrowband voice signals;

decoding by a second wideband decoder the input encoded wideband voice data;

expanding by a band expander the N narrowband voice signals into a wideband voice signal;

mixing by a second mixer the wideband voice signal obtained through decoding by the second wideband decoder with the wideband voice signal obtained by the band expander to thereby produce a third signal;

converting by a band limiter the third into a narrowband voice signal when the destination terminal is compatible with the encoded narrowband voice data;

encoding by a second narrowband encoder the narrowband voice signal output from the band limiter;

encoding by a second wideband encoder the third to thereby produce the encoded wideband voice data of layered structure when the destination terminal is compatible with the encoded wideband voice data; and selecting by a second selector either of the encoded wideband voice data output from the first narrowband encoder and the encoded narrowband voice data output from the second wideband encoder, and selecting either of the encoded wideband voice data output from the first wideband encoder and the encoded wideband voice data output from the second wideband encoder.

6. A voice mixing method of carrying out mixing on encoded narrowband voice data sent from N narrowband terminals, where N is a natural number, and encoded wideband voice data of layered structure that are sent from M wideband terminals, where M is a natural number, the encoded wideband voice data including first encoded voice data for a narrowband region and second encoded voice data for a region outside a narrowband, said method comprising the steps of:

decoding by a narrowband decoder the input encoded narrowband voice data to thereby produce N narrowband voice signals;

decoding by a wideband decoder the input encoded wideband voice data;

expanding by a band expander the N narrowband voice signals into a wideband voice signal;

mixing by a mixer the wideband voice signal obtained through decoding by the wideband decoder with the wideband voice signal obtained by the band expander to thereby produce a first signal;

converting by a band limiter the first signal into a narrowband voice signal when a destination terminal is compatible with the encoded narrowband voice data;

encoding by a narrowband encoder the narrowband voice signal output from the band limiter; and encoding by a wideband encoder the first signal to thereby produce the encoded wideband voice data of layered structure when the destination terminal is compatible with the encoded wideband voice data.

7. A non-transitory computer-readable storage medium having a voice mixing program recorded thereon which controls, when installed and executed on a computer, the computer to function as a voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, said apparatus comprising:

a first narrowband decoder that decodes the input encoded narrowband voice data to thereby produce N narrowband voice signals;

a first wideband decoder that splits the input encoded wideband voice data into the first encoded voice data and the second encoded voice data, and decodes the first encoded voice data to thereby produce M narrowband voice signals;

a maximum narrowband voice signal detector that detects a first signal highest in level among N+M narrowband voice signals including the N narrowband voice signals and the M narrowband voice signals;

a first selector that expands, when the first signal is detected among the N narrowband voice signals, the first signal into a wideband voice signal and then encodes a signal of a region outside the narrowband of the expanded wideband voice signal to output the encoded signal, and outputs, when the first signal is detected among the M narrowband voice signals, the first encoded voice data and the second encoded voice data;

a first mixer that mixes the narrowband voice signal obtained through decoding by said first narrowband decoder with the narrowband voice signal obtained through decoding by said first wideband decoder to thereby produce a second signal;

a first narrowband encoder that encodes the second signal when a destination terminal is compatible with the encoded narrowband voice data; and a first wideband encoder that encodes, when the destination terminal is compatible with the encoded wideband voice data, the narrowband region of the second signal to thereby produce first encoded voice data, and combining the first encoded voice data produced with the second encoded voice data output from said first selector to thereby form the encoded wideband voice data of layered structure.

8. The storage medium according to claim 7, wherein said program further controls the computer to function as the apparatus which further comprises:

a second narrowband decoder that decodes the input encoded narrowband voice data to thereby produce N narrowband voice signals;

a second wideband decoder that decodes the input encoded wideband voice data;

a band expander that expands the N narrowband voice signals into a wideband voice signal;

a second mixer that mixes the wideband voice signal obtained through decoding by said second wideband decoder with the wideband voice signal obtained by said band expander to thereby produce a third signal;

a band limiter that converts, when the destination terminal is compatible with the encoded narrowband voice data, the third signal into a narrowband voice signal;

a second narrowband encoder that encodes the narrowband voice signal output from said band limiter;

a second wideband encoder that encodes, when the destination terminal is compatible with the encoded wideband voice data, the third signal to thereby produce the encoded wideband voice data of layered structure; and a second selector that selects either of the encoded wideband voice data output from said first narrowband encoder and the encoded narrowband voice data output from said second wideband encoder, and selects either of the encoded wideband voice data output from said first wideband encoder and the encoded wideband voice data output from said second wideband encoder.

9. A voice non-transitory computer-readable storage medium having a mixing program recorded thereon which controls, when installed and executed on a computer, the computer to function as a voice mixing apparatus for conducting mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, said apparatus comprising:

a narrowband decoder that decodes the input encoded narrowband voice data to thereby produce N narrowband voice signals;

a wideband decoder that decodes the input encoded wideband voice data;

a band expander that expands the N narrowband voice signals into a wideband voice signal;

a mixer that mixes the wideband voice signal obtained through decoding by said wideband decoder with the wideband voice signal obtained by said band expander to thereby produce a first signal;

a band limiter that converts, when a destination terminal is compatible with the encoded narrowband voice data, the first signal into a narrowband voice signal;

a narrowband encoder that encodes the narrowband voice signal output from said band limiter; and a wideband encoder that encodes, when the destination terminal is compatible with the encoded wideband voice data, the first signal to thereby produce the encoded wideband voice data of layered structure.

10. A voice conference system comprising a voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, said apparatus comprising:

a first narrowband decoder that decodes the input encoded narrowband voice data to thereby produce N narrowband voice signals;

a first wideband decoder that splits the input encoded wideband voice data into the first encoded voice data and the second encoded voice data, and decodes the first encoded voice data to thereby produce M narrowband voice signals;

a maximum narrowband voice signal detector that detects a first signal highest in level among N+M narrowband voice signals including the N narrowband voice signals and the M narrowband voice signals;

a first selector that expands, when the first signal is detected among the N narrowband voice signals, the first signal into a wideband voice signal and then encodes a signal of a region outside the narrowband of the expanded wideband voice signal to output the encoded signal, and outputs, when the first signal is detected among the M narrowband voice signals, the first encoded voice data and the second encoded voice data;

a first mixer that mixes the narrowband voice signal obtained through decoding by said first narrowband decoder with the narrowband voice signal obtained through decoding by said first wideband decoder to thereby produce a second signal;

a first narrowband encoder that encodes the second signal when a destination terminal is compatible with the encoded narrowband voice data; and a first wideband encoder that encodes, when the destination terminal is compatible with the encoded wideband voice data, the narrowband region of the second signal to thereby produce first encoded voice data, and combining the first encoded voice data produced with the second encoded voice data output from said first selector to thereby form the encoded wideband voice data of layered structure.

11. The system according to claim 10, wherein said apparatus further comprises:

a second narrowband decoder that decodes the input encoded narrowband voice data to thereby produce N narrowband voice signals;

a second wideband decoder that decodes the input encoded wideband voice data;

a band expander that expands the N narrowband voice signals into a wideband voice signal;

a second mixer that mixes the wideband voice signal obtained through decoding by said second wideband decoder with the wideband voice signal obtained by said band expander to thereby produce a third signal;

a band limiter that converts, when the destination terminal is compatible with the encoded narrowband voice data, the third signal into a narrowband voice signal;

a second narrowband encoder that encodes the narrowband voice signal output from said band limiter;

a second wideband encoder that encodes, when the destination terminal is compatible with the encoded wideband voice data, the third signal to thereby produce the encoded wideband voice data of layered structure; and a second selector that selects either of the encoded wideband voice data output from said first narrowband encoder and the encoded narrowband voice data output from said second wideband encoder, and selects either of the encoded wideband voice data output from said first wideband encoder and the encoded wideband voice data output from said second wideband encoder.

12. A voice conference system comprising a voice mixing apparatus for carrying out mixing on encoded narrowband voice data sent from N narrowband terminals, where N is a natural number, and encoded wideband voice data of layered structure that are sent from M wideband terminals, M is a natural number, the encoded wideband voice data including first encoded voice data for a narrowband region and second encoded voice data for a region outside a narrowband, said apparatus comprising:

a narrowband decoder that decodes the input encoded narrowband voice data to thereby produce N narrowband voice signals;

a wideband decoder that decodes the input encoded wideband voice data;

a band expander that expands the N narrowband voice signals into a wideband voice signal;

a mixer that mixes the wideband voice signal obtained through decoding by said wideband decoder with the wideband voice signal obtained by said band expander to thereby produce a first signal;

a band limiter that converts, when a destination terminal is compatible with the encoded narrowband voice data, the first signal into a narrowband voice signal;

a narrowband encoder that encodes the narrowband voice signal output from said band limiter; and a wideband encoder that encodes, when the destination terminal is compatible with the encoded wideband voice data, the first signal to thereby produce the encoded wideband voice data of layered structure.

* * * * *